US007850587B2

(12) United States Patent
Sano

(10) Patent No.: US 7,850,587 B2
(45) Date of Patent: Dec. 14, 2010

(54) BEND ADJUSTABLE ROLLER

(75) Inventor: Takayoshi Sano, Fuji (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 1093 days.

(21) Appl. No.: 11/549,988

(22) Filed: Oct. 17, 2006

(65) Prior Publication Data

US 2007/0090227 A1 Apr. 26, 2007

(30) Foreign Application Priority Data

Oct. 20, 2005 (JP) ..... 2005-305632

(51) Int. Cl.
*B29C 43/46* (2006.01)

(52) U.S. Cl. ..... 492/6; 492/2; 492/47; 492/21

(58) Field of Classification Search ..... 492/1, 492/2, 6, 21, 45, 47
See application file for complete search history.

(56) References Cited

U.S. PATENT DOCUMENTS

| | | | | |
|---|---|---|---|---|
| 3,672,018 | A * | 6/1972 | Junk et al. | 492/7 |
| 3,676,909 | A * | 7/1972 | Tuomaala | 492/6 |
| 3,728,767 | A * | 4/1973 | Shirai | 26/104 |
| 3,729,788 | A * | 5/1973 | Tawa | 26/104 |
| 4,372,205 | A * | 2/1983 | Pflaum | 101/153 |
| 4,470,183 | A | 9/1984 | Kuosa | |
| 4,477,954 | A * | 10/1984 | Molinatto | 492/7 |
| 4,487,122 | A * | 12/1984 | George et al. | 101/153 |
| 4,510,865 | A * | 4/1985 | Molinatto | 101/153 |
| 6,073,474 | A | 6/2000 | Dittmar | |
| 6,468,194 | B2 * | 10/2002 | Wojtkowski et al. | 492/47 |
| 2003/0073937 | A1 | 4/2003 | Guitay | |
| 2005/0184445 | A1 | 8/2005 | Feijen | |
| 2008/0203130 | A1 * | 8/2008 | Kerschbaumer et al. | 226/108 |
| 2008/0207419 | A1 * | 8/2008 | Kerschbaumer et al. | 492/20 |
| 2008/0210733 | A1 * | 9/2008 | Kerschbaumer et al. | 226/194 |

FOREIGN PATENT DOCUMENTS

| | | |
|---|---|---|
| CN | 1194184 | 9/1998 |

(Continued)

OTHER PUBLICATIONS

Search Report issued in counterpart Taiwanese Application No. 095138409, Mailed Jul. 1, 2008.

(Continued)

*Primary Examiner*—Essama Omgba
(74) *Attorney, Agent, or Firm*—DLA Piper LLP (US)

(57) ABSTRACT

A roller has an outer tubular member, a central shaft, a connecting member that connect the outer tubular member and the central shaft at a central area of an axis of the roller, connecting the outer tubular member and the central shaft, a bend adjustable mechanism disposed between the outer tubular member and the central shaft at both ends of the roller, a first bearing structure that engages the outer tubular member and the bend adjustable mechanism; a second bearing structure that engages the bend adjustable mechanism and the central shaft; and a rotation preventing mechanism that prevents rotation of the bend adjustable mechanism. The bend adjustable mechanism has a plurality of spacer structures that individually adjust a distance between the first bearing structure and the second bearing structure in a radial direction of the roller.

3 Claims, 6 Drawing Sheets

FOREIGN PATENT DOCUMENTS

| | | | |
|---|---|---|---|
| CN | 1681610 | | 10/2005 |
| DE | 34 48 260 | C2 | 6/1989 |
| DE | 32 21 011 | C2 | 8/1993 |
| DE | 93 19 240 | U | 4/1994 |
| DE | 199 27 897 | A1 | 12/2000 |
| DE | 10 2005 044 957 | A1 | 3/2004 |
| DE | 10 2004 045 407 | A1 | 4/2005 |
| DE | 10 2005 044 956 | A1 | 3/2007 |
| JP | 05-178505 | | 7/1993 |
| JP | P3158306 | | 2/2001 |
| TW | 332171 | | 5/1998 |
| TW | 473404 | | 1/2002 |
| TW | 483755 | | 4/2002 |
| TW | 497999 | | 8/2002 |

OTHER PUBLICATIONS

English lanugage abstract of CN 1681610, published Oct. 12, 2005.
English language abstract of CN 1194184, published Sep. 30, 1998.
Machine English language translation of JP P3158306, issued Feb. 16, 2001.
English language abstract of TW 497999, published Aug. 11, 2002.
English language abstract of TW 332171, published May 21, 1998.
Office Action issued in counterpart German Application No. 10 2006 049 290.0-22, dated Sep. 19, 2007, accompanied by an English language translation.

* cited by examiner

BEND ADJUSTABLE ROLLER

BACKGROUND OF THE INVENTION

1. Field of the Invention

The present invention relates to rollers such as a contact roller (pressure roller) or a nip roller used in web winding devices or devices for film sheets, and more particularly to a bend adjustable roller.

2. Description of the Related Art

With an increase in the width of web materials, the shaft of a contact roller used in web winding devices is made longer. The contact roller has the ratio of the length of the shaft to the diameter of the contact roller has recently taken a value from 15 to 30. This leads us to an undesirable phenomenon that the contact roller bends in an arch-like form between bearings on both ends in a direction away from the winding shaft of a web winding device, even though with high stiffness or light weight. Accordingly, on the shaft of the contact roller nip pressure is less at its center than at its ends. This results in forming sheets with winding wrinkle, winding knob, or winding slippage with low quality.

Japanese Patent Laid-Open No. H6-39300 discloses a contact roller device that is capable of adjusting bending amount to be applied on the contact roller. The device has a pair of control shafts, a plurality of roller bearings (ball bearings), each bearing supporting an end area of each control shaft; and movable frames which hold the roller bearings. The roller bearings are aligned in the axial direction of each control shaft. Pushing the movable frames in a horizontal direction with cylinder devices gives bending force on one end of each control shaft to bend the contact roller.

However, this requires the large force of the cylinder devices because the contact roller device has a limitation on the length between the roller bearings aligned in the axial direction due to its mechanical structure. Accordingly, the large force is required to obtain a predetermined amount of bending.

Such large force makes the life of the roller bearings shortened and the rotation loss of the roller increased.

Moreover, the roller bearings and the movable frames holding the roller bearings receive the reaction force of the bending force. Since in general there is provided a shift frame for shifting the contact roller in backward depending on winding-slack amount with the swing mechanism, the contact roller cannot receive large force. Even so, taking this method makes a winding slack adjusting mechanism and a swing mechanism large and complicated.

SUMMARY OF THE INVENTION

To achieve the above issues, an object of the present invention is to provide a roller capable of obtaining a predetermined amount of bending by a smaller force than before without modifying the winding slack adjusting mechanism and the swing mechanism.

A first aspect of the present invention provides a roller comprising: an outer tubular member; a central shaft penetrating the outer tubular member in an axial direction of the roller; a connecting member disposed between the outer tubular member and the central shaft at a central area of an axis of the roller, connecting the outer tubular member and the central shaft; a bend adjustable mechanism disposed between the outer tubular member and the central shaft at both ends of the axis; a first bearing structure that engages the outer tubular member and the bend adjustable mechanism; a second bearing structure that engages the bend adjustable mechanism and the central shaft, the second bearing structure being aligned with the first bearing structure in an radial direction of the roller; and a rotation preventing mechanism that prevents rotation of the bend adjustable mechanism, wherein the bend adjustable mechanism comprises a plurality of spacer structures that individually adjust a distance between the first bearing structure and the second bearing structure in the radial direction of the roller.

DETAILED DESCRIPTION OF THE PREFERRED EMBODIMENTS

Figure 1:
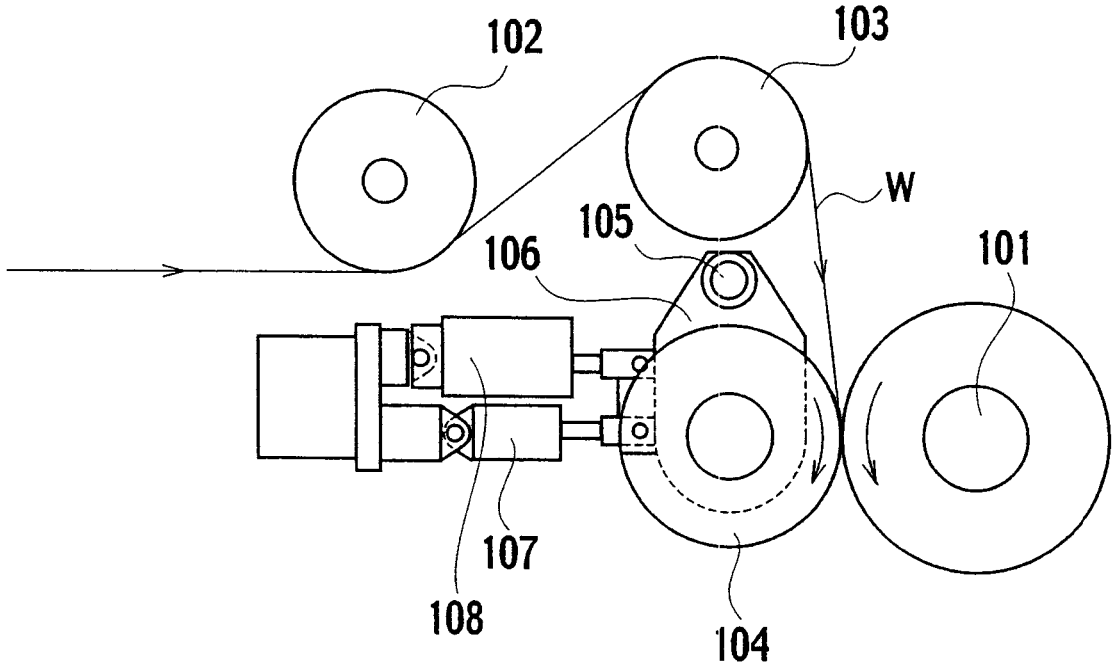
FIG. 1 is a side view showing the whole structure of a web winding device using a bend adjustable roller of the present invention as a contact roller.

With reference to FIG. 1, there is described a web winding device using a bend adjustable roller of the present invention as a contact roller.

The web winding device comprises a wind-up shaft (bobbin) 101, a hold-down roller 102, a tension roller 103, and a contact roller 104 parallel to the wind-up shaft 101. The wind-up shaft 101 winds up a web material "W" guided by the hold-down roller 102 and the tension roller 103. This wind-up is performed under nip pressure by the contact roller 104 pressing the web W against the web winding device 101.

The web winding device further comprises a shaft 105, a swing member 106, an air-pressure cylinder device 107, and a damper 108. The contact roller 104 is rotatably mounted on the swing member 106 which is pivotally mounted around the shaft 105. The swing member 106 is biased by the air-pressure cylinder device 107 in the web pressing direction of the contact roller 104. The damper 108 is mounted to the swing member 106 to absorb vibration.

It is noted that the contact roller 104, the shaft 105, the swing member 106, the air-pressure cylinder device 107, and the damper 108 are provided on a movable plate of a winding slack adjusting mechanism (not shown).

A bend adjustable roller according to the present invention is applied to the above contact roller 104 as one example of use.

With reference to FIGS. 2 to 6, the bend adjustable roller in one embodiment according to the present invention is described.

Figure 2:
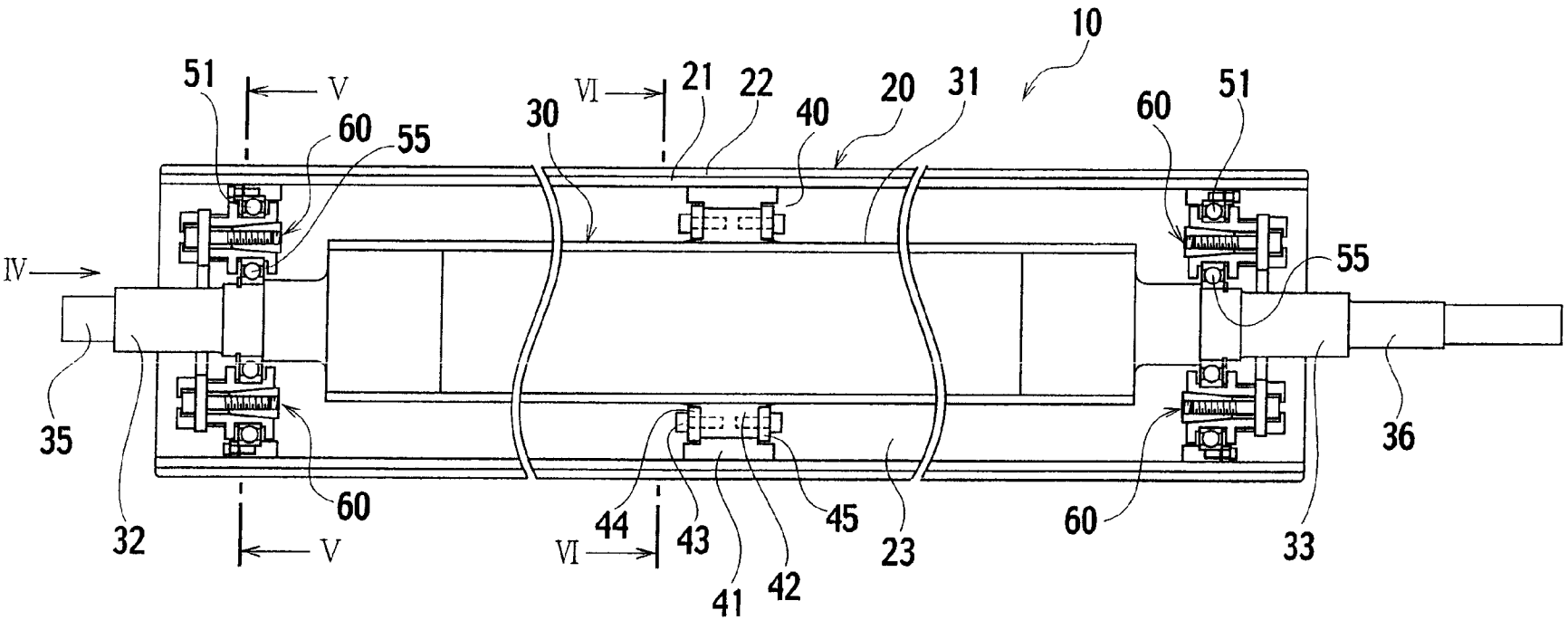
FIG. 2 is a cross-sectional view showing the bend adjustable roller in one embodiment.

As shown in FIG. 2, a bend adjustable roller (roller) 10 comprises an outer tubular member 20 and a central shaft 30.

The outer tubular member 20 is cylindrical in shape with both ends open. The outer tubular member 20 comprises a elastic metal cylindrical member 21 of a thin structure and a rubber roller 22 which is put up on the whole outer circumferential surface of the flexible metal cylindrical member 21.

The central shaft 30 penetrates a tubular cavity 23 of the outer tubular member 20 in an axial direction of the roller 10. The central shaft 30 comprises a metal cylindrical member 31, metal shaft members 32, 33, each of which is fixedly connected to each end of the metal cylindrical member 31.

The metal shaft members 32, 33 respectively extend outward through the opened ends of the cylindrical member 31. The shaft members 32, 33 have shaft bearing members 35, 36 which are rotatably supported by bearing members (not shown), or ball bearings, disposed on the swing member 106 (FIG. 1).

The outer tubular member 20 and the central shaft 30 are fixedly connected with each other by a connecting member 40 at a center area of the axis of the roller 10, so that the outer tubular member 20 and the control shaft 30 are arranged in concentric pattern at the center area of the axis of the roller 10. Accordingly, the rotation torque of the central shaft 30 is transmitted to the outer tubular member 20. That means the outer tubular member 20 and the central shaft 30 rotate integrally. The connecting member 40 comprises a ring member 41 fixedly mounted to an inner circumferential surface of the elastic metal cylindrical member 21, a ring member 42 fixedly mounted to an outer circumferential surface of the central shaft 30; a plurality of bolts 43 connecting the ring members 41, 42, and holding rings 44, 45 (see FIGS. 2 and 6).

Figure 3:
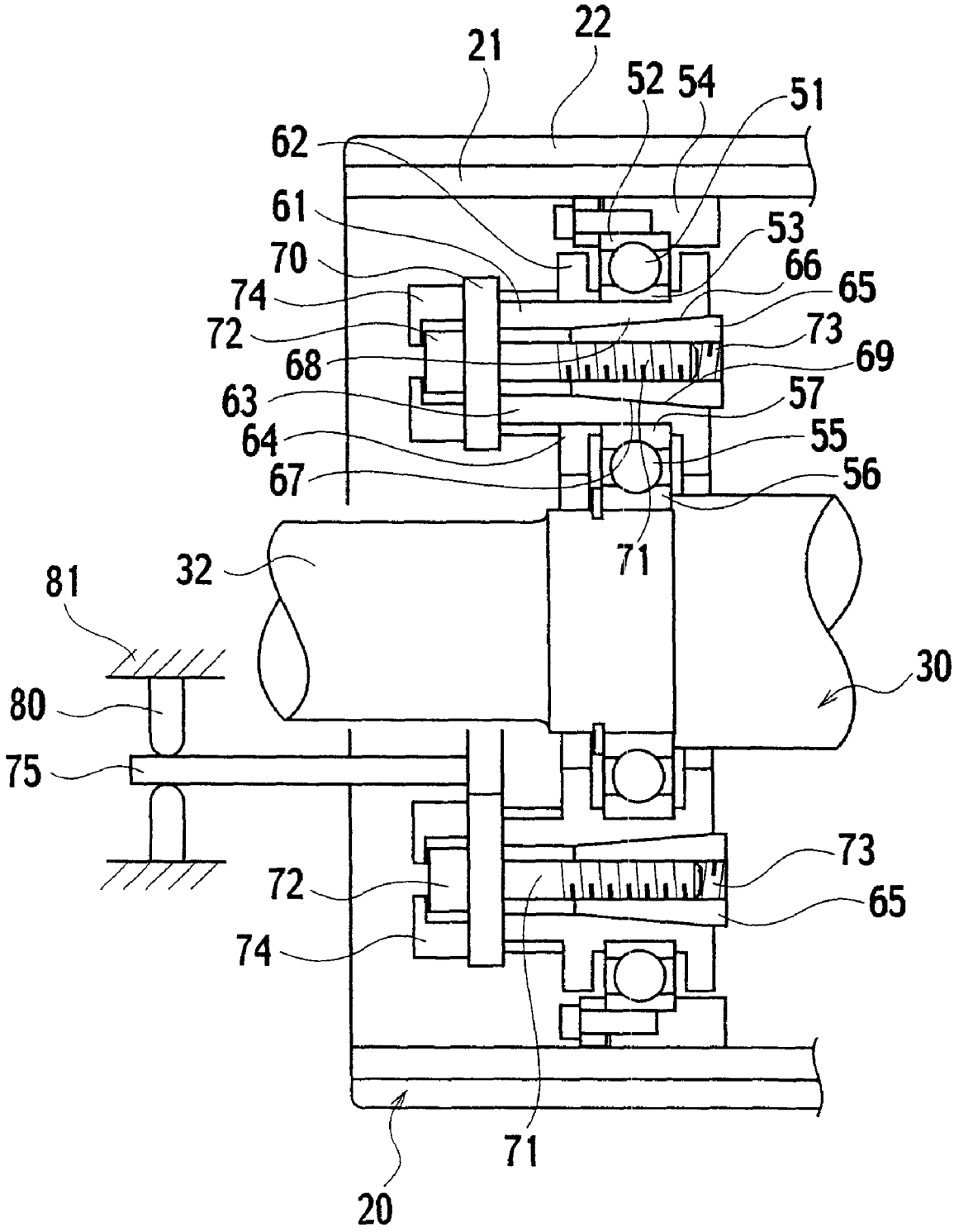
FIG. 3 is an enlarged sectional view showing a main part of the bend adjustable roller shown in FIG. 2.
Figure 4:
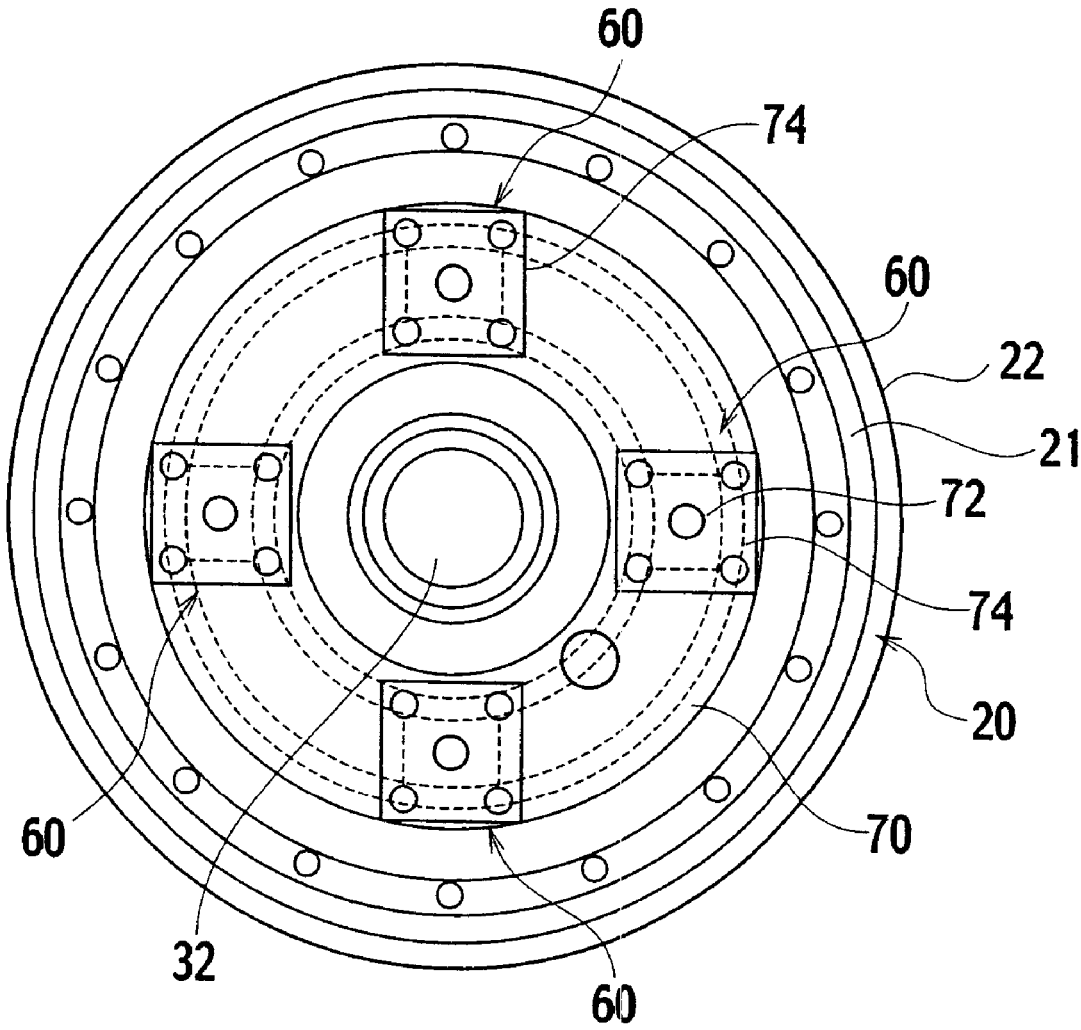
FIG. 4 is an enlarged sectional view of FIG. 2 from a view point IV.

Between the outer tubular member 20 and the central shaft 30, at each end of the roller 10, there are provided a plurality of outer roller bearings 51 and a plurality of inner roller bearings 55. FIG. 3 shows a detailed structure of the roller 10 at one end (left side of FIG. 2) thereof in this embodiment. Since another end of the roller 10 has the same structure, we will hereinafter omit the description of the structure of the roller 10 at the right side. An outer race 52 of the outer roller bearings 51 is fixedly mounted to an inner circumferential surface of the outer tubular member 20 (inner circumferential surface of the elastic metal cylindrical member 21) by a mount ring member 54. An inner race 56 of the inner roller bearings 55 is fixedly mounted to a position corresponding to the position of the outer roller bearing 51 in the axial direction, which is on the outer circumferential surface of the shaft members 32 in the embodiment.

Figure 5:
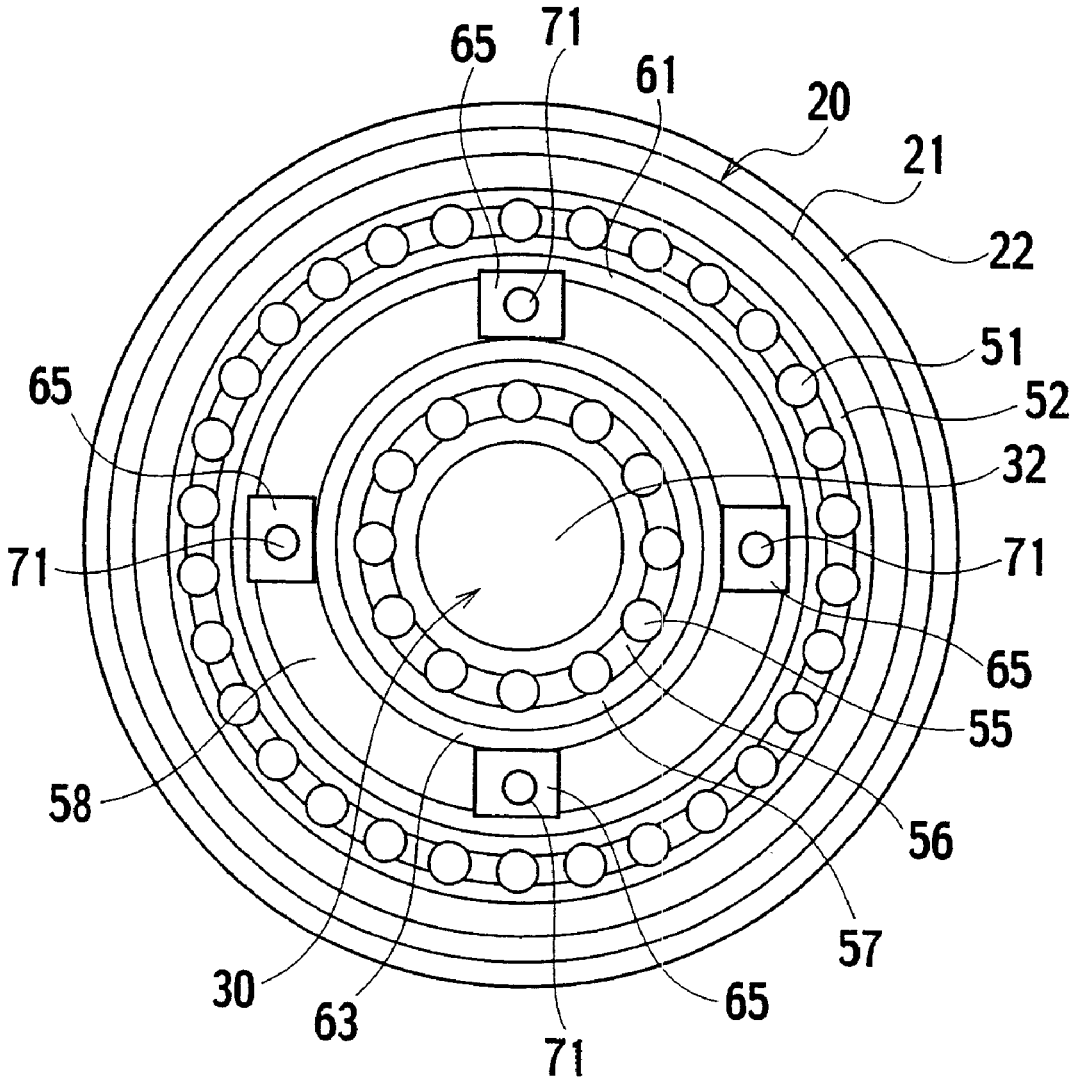
FIG. 5 is an enlarged sectional view of FIG. 2 at a line V-V.
Figure 6:
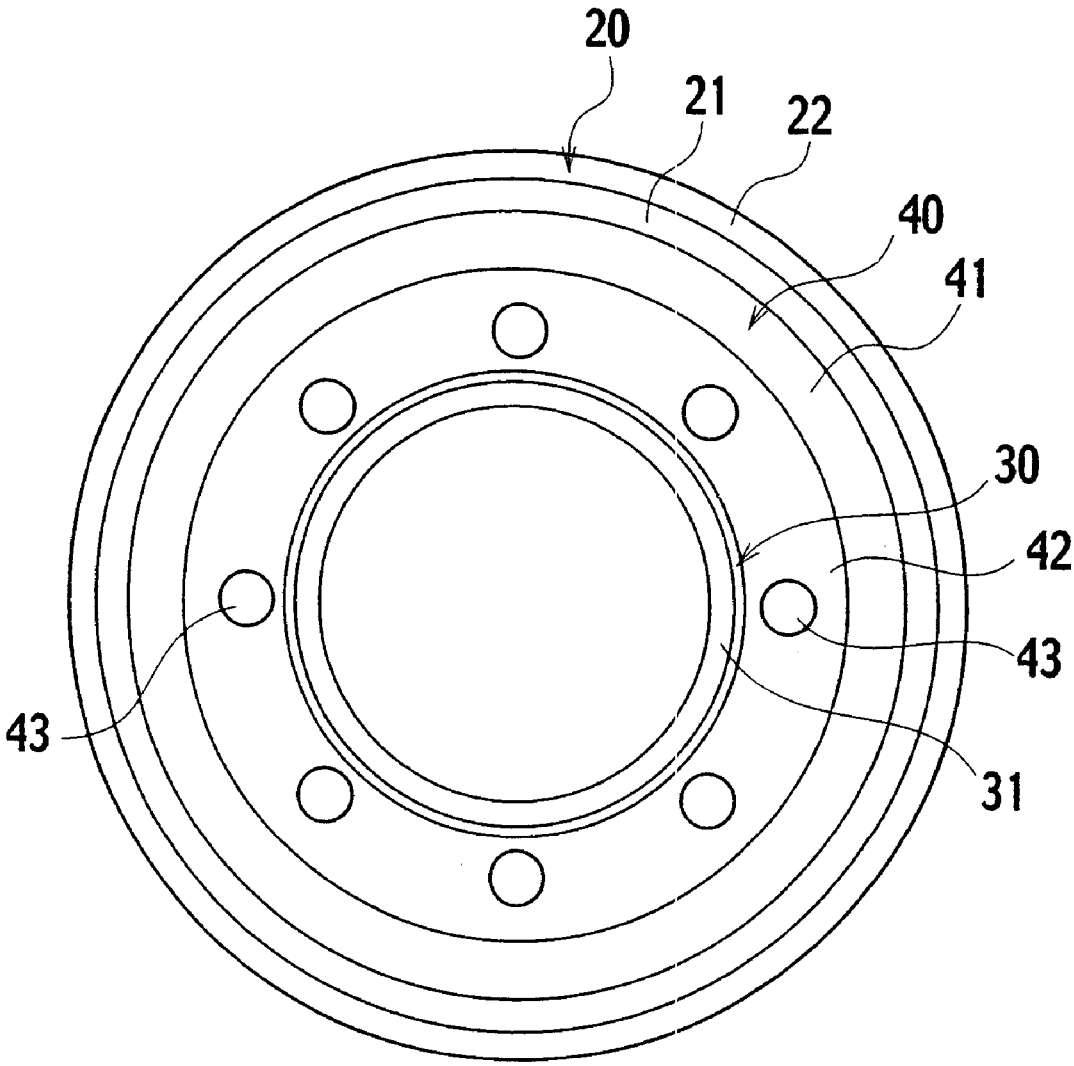
FIG. 6 is an enlarged sectional view of FIG. 2 at a line VI-VI.

As shown in FIG. 5, at the left side of the roller 10 there is provided a bend adjustable mechanism 60,61,63 inside a cylindrical interspace defined by an inner race 53 of a plurality of outer roller bearings 51 and an outer race 57 of a plurality of inner roller bearings 55, hereinafter called the "left bend adjustable mechanism". The left bend adjustable mechanism 60,61,63 comprises a plurality of spacer structures 60 that are circumferentially arranged with equidistance. In this embodiment there are provided four spacer structures. The spacer structures 60 individually adjusts a distance between the inner race 53 of the outer roller bearing 51 and the outer race 57 of the inner roller bearings 55 in a radial direction of the roller 10.

The left bend adjustable mechanism 60,61,63 comprises an outer ring member 61, an inner ring member 63, and the plurality of spacer structures 60. Each spacer structure 60 comprises a cotter block 65 and an adjusting screw 71. As shown in FIG. 3, the cotter blocks 65 are disposed between the ring members 61, 63. The outer ring member 61 is fixed to the inner race 53 of the outer roller bearings 51 to sandwich the inner race 53 with a hold ring 62. The inner ring member 63 is fixed to the outer race 57 of the inner roller bearings 55 to sandwich the outer race 57 with a hold ring 64. As shown in FIG. 5, the cotter blocks 65 are circumferentially arranged with equidistance. Upper and lower blocks are worked with each other as well as a pair of left and right blocks.

Each cotter block 65 has an outer tapered surface (inclined surface) 66 and an inner tapered surface 67 (inclined surface). The outer tapered surface 66 touches a tapered surface (inclined surface) 68 formed on an inner circumferential surface of the outer ring member 61. The inner tapered surface 67 touches a tapered surface (inclined surface) 69 formed on an outer circumferential surface of the inner ring member 63.

There is provided a ring hold member 70 which contacts the outer ring member 61 and the inner ring member 63 at their ends (outer ends in the axial direction). The ring hold member 70 is engaged with a bolt head member 72 of an adjusting screw 71. The adjusting screw 71 penetrates the ring hold member 70 in the axial direction of the roller 10 to be screw-engaged in a screw hole 73 formed on the cotter block 65. On the ring hold member 70, there is a bolt holder 74 mounted to prevent the rotation of the bolt head 72 of the adjusting screw 71.

The ring hold member 70 has a rotation detent pin 75 fixedly mounted thereon. The rotation detent pin 75 extends outward from the opened end of the outer tubular member 20. The rotation detent pin 75 is engaged with a rotation preventing structure 80 that is fixed to a fix side member 81 (outside area of the roller 10). This engagement prevents the rotation of the ring hold member 70 against the fix side member 81.

The above described mechanism prevents the rotations of the following members: the outer ring member 61; the inner ring member 63; the hold rings 62, 64; the cotter blocks 65; the ring hold member 70; the adjusting bolts 71; and the bolt holder 74. At the same time, the rotations of the outer tubular member 20 and the central shaft 30 engaged with the above stopped members are enabled by the outer roller bearings 51 and the inner roller bearings 55.

The cotter blocks 65 move between the outer ring member 61 and the inner ring member 63 in the axial direction of the roller 10 (FIG. 3, in a horizontal direction) depending on a screw amount of the adjusting screws 71. The movements adjust the distance between the inner race 53 of the outer roller bearings 51 and the outer race 57 of the inner roller bearings 55 in the radial direction of the roller 10, which is enabled by the engagement between the tapered surfaces 66 and 68, and 67 and 69.

In detail, the bend adjustable mechanism described above is performed by an opposed pair of the cotter blocks such as the upper and lower blocks 65, 65 in FIG. 5. Screwing-in the upper adjusting screw 71 moves the upper block 65 left (away from the center of the axis) to increase the upper radial distance. Screwing-out the lower adjusting screw 71 moves the lower block 65 right (close to the center of the axis) to reduce the lower radial distance. Putting this into a pair of left and right blocks 65, 65 in FIG. 5, increasing the right radial distance and reducing the left radial distance enables the circumference of the outer tubular member 20 to move right from the central shaft 30. This gives bending on the roller 10.

At both ends of the roller 10, the bending amount adjustment is individually performed. The bending is given within a bending span between the end and the center of the axis, that is, between the spacer structure 60 and the connecting member 40 which connects the outer tubular member 20 and the central shaft 30. The amount of bending corresponds to the amount of moving of the outer tubular member 20 from the central shaft 30. Therefore, fine-tuning of the bending amount with high accuracy is enabled by adjusting the screwing amount in adjusting screw method.

Obtaining a predetermined amount of bending requires less force than that in the related art, as the bending of the roller 10 is performed within the bending span between the center and the edge of the axis.

This improves the life and rotation loss of the outer roller bearings 51 and the inner roller bearings 55 due to bending. Since the reaction force of the bending is held within the roller by the outer roller bearings 51 and the inner roller bearings 55, no modification is required in the swing mechanism and the winding slack adjusting mechanism.

Note that a direction of moving the circumference of the outer tubular member 20 from the central shaft 30 is changeable and adjustable because the rotation preventing structure 80 is enabled to change the position of the rotation detent pin 75 on the ring hold member 70 in a rotation direction.

Each spacer structure 60 is not limited to the cotter block type. It is possible to use an eccentric cam type, hydraulic pressure type, or a thermal expansion type. It is also possible to control automatically the bending amount or the bending direction depending on a web winding diameter of a corresponding bobbin or a web thickness by providing a remote-controlled power source on the spacer structure 60.

The roller according to the present invention is not limited to be applied to contact rollers used in web winding devices. It is also possible to apply the roller to nip rollers which press sheet films against roller surface when the sheet films pass through rotating rollers.

This application is based upon the Japanese Patent Applications No. 2005-305632, filed on Oct. 20, 2005, the entire content of which is incorporated by reference herein.

Although the present invention has been described above by reference to certain embodiments of the invention, this invention is not limited to these embodiments and modifications will occur to those skilled in the art, in light of the teachings. The scope of the invention is defined with reference to the following claims.

What is claimed is:

1. A roller comprising:

an outer tubular member;

a central shaft penetrating the outer tubular member in an axial direction of the roller;

a connecting member disposed between the outer tubular member and the central shaft at a central area of an axis of the roller, connecting the outer tubular member and the central shaft;

a bend adjustable mechanism disposed between the outer tubular member and the central shaft at both ends of the axis;

a first bearing structure that engages the outer tubular member and the bend adjustable mechanism;

a second bearing structure that engages the bend adjustable mechanism and the central shaft, the second bearing structure being aligned with the first bearing structure in a radial direction of the roller; and a rotation preventing mechanism that prevents rotation of the bend adjustable mechanism, where:

the bend adjustable mechanism comprises a plurality of spacer structures that individually adjust a distance between the first bearing structure and the second bearing structure in the radial direction of the roller, each spacer structure comprises a cotter block and an adjusting screw to be screw-engaged in the cotter block, and the cotter block moves in the axial direction of the roller depending on an amount of screwing of the adjusting screw to adjust the distance between the first bearing structure and the second bearing structure in the radial direction of the roller.

2. The roller of claim 1, wherein:

the first bearing mechanism comprises a first outer race, a first inner race, and a first roller bearing, the second bearing mechanism comprises a second outer race, a second inner race, and a second roller bearing, the bend adjustable mechanism further comprises an outer ring member and an inner ring member, and the first outer race is fixedly mounted to the outer tubular member, the first inner race is fixedly mounted to the outer ring member, the second outer race is fixedly mounted to the inner ring member, and the second inner race is fixedly mounted to the central shaft.

3. The roller of claim 1, wherein the rotation preventing mechanism comprising a ring hold member engaged with the bend adjustable mechanism and a rotation detent pin that fixedly supports the ring hold member to an outer area of the roller.

* * * * *